US005963992A

United States Patent [19]

Bonner

[11] Patent Number: 5,963,992

[45] Date of Patent: Oct. 12, 1999

[54] HANDLE ATTACHMENT FOR TOILET SEAT

[76] Inventor: Sam W. Bonner, 296 NE. Boulevard N, St. Petersburg, Fla. 33702

[21] Appl. No.: 09/092,640

[22] Filed: Jun. 5, 1998

[51] Int. Cl.[6] ..... A47K 13/10

[52] U.S. Cl. ..... 4/246.1

[58] Field of Search ..... 4/246.1

[56] References Cited

U.S. PATENT DOCUMENTS

| | | | |
|---|---|---|---|
| D. 331,184 | 11/1992 | Walker | D8/307 |
| 3,191,193 | 6/1965 | Bogenberger . | |
| 4,129,907 | 12/1978 | Vaughan et al. . | |
| 4,742,582 | 5/1988 | Giallourakis . | |
| 4,805,246 | 2/1989 | De Vargas et al. . | |
| 4,850,062 | 7/1989 | Gibson et al. . | |
| 4,920,586 | 5/1990 | Giallourakis . | |
| 5,027,472 | 7/1991 | Goodman . | |
| 5,058,215 | 10/1991 | Sims . | |
| 5,065,460 | 11/1991 | Currin | 4/246.1 |
| 5,086,523 | 2/1992 | De Mott et al. . | |
| 5,220,693 | 6/1993 | Paglia | 4/246.1 |
| 5,375,267 | 12/1994 | Davis . | |
| 5,553,332 | 9/1996 | Hazard | 4/246.1 |

*Primary Examiner*—Charles E. Phillips
*Attorney, Agent, or Firm*—Chase & Yakimo, L.C.

[57] ABSTRACT

A handle attachment assembly for a toilet seat is disclosed for manually raising or lowering a toilet seat without a user having to touch the toilet seat proper. The handle attachment includes an attachment plate securable to the underside of a toilet seat with an adhesive. The attachment plate further includes a rigid flange which grips the interior edge of the opening of the toilet seat. This flange serves as a guide for proper alignment of the seat and provides lifting support to the seat for reducing strain on the adhesive. The handle attachment assembly further includes a handle which is grasped by a user for raising or lowering the toilet seat. The handle is demountably attached to the attachment plate and extends outwardly therefrom. The handle is thus removable for cleaning or for replacement with handles of various aesthetic designs.

10 Claims, 5 Drawing Sheets

HANDLE ATTACHMENT FOR TOILET SEAT

BACKGROUND OF THE INVENTION

This invention relates to a sanitary device for a toilet and, more particularly, to a handle attachment for raising or lowering a toilet seat without touching the seat proper.

Raising and lowering a toilet seat by manually grasping an edge or underside of the seat is undesirable in that the underside of the seat tends to be unsanitary due to its proximity to the toilet bowl itself. Germs which reside on the toilet seat may be transferred to users who raise or lower the seat before or after use, particularly since the toilet is not usually sanitized following each use.

Various devices have been proposed in the art for lifting a toil et seat without touching the seat itself. Each device proposed in U.S. Pat. Nos. 4,805,246 to De Vargas et al, U.S. Pat. No. 4,920,586 to Giallourakis, and U.S. Pat. No. 4,850,062 to Gibson et al include a handle or lifting means adhesively attached to the underside of a toilet seat. Although assumably effective in operation, the adhesive is stretched, strained, or otherwise taxed each time the handle is engaged to lift the seat, the strain being caused by the weight of the seat and possibly a lack of gentleness by the user. Over time, it is anticipated that the adhesive means of attachment will fail and the lifting means will require replacement.

In addition, a repositionable toilet seat handle is disclosed in U.S. Pat. No. 5,027,472 to Goodman having a pair of clamps which cooperate with a threaded bolt to removably engage a toilet seat. While assumably effective for adjusting the position of the handle, the device requires numerous parts which may become loose during use or repositioning, causing the device to lose its position or fall off the seat. Further, it is anticipated that the threaded bolt will become rusty due to its exposure to the moist and unsanitary underside of the toilet seat, the rust eventually inhibiting proper screwable positioning of the clamping elements. U.S. Pat. No. 3,191,193 presents a clamping arrangement with a spring mounted to the underside of the seat which is disadvantageous for the same reasons described above.

Thus, it is desirable to have a handle attachment for lifting a toilet seat which is adhesively attachable to the underside of a toilet seat and which includes a seat grasping mechanism for reducing the strain on the adhesive attachment means. It is further desirable that no movable elements of the handle attachment be exposed to the moist or unsanitary parts of the toilet bowl or seat.

SUMMARY OF THE INVENTION

In response thereto, I have invented a handle attachment for raising or lowering a toilet seat which includes an attachment portion, a handle portion, and attachment means. The attachment portion includes an adhesive attachment medium for securing an attachment plate to the underside of a toilet seat, the attachment plate having front and rear edges which conform to the curvature of the toilet seat. In addition, the front edge of the attachment plate includes a convex seat grasping member which grips the interior edge of the toilet seat, the seat grasping member providing lifting support to the toilet seat which reduces strain on the adhesive attachment means. Stretching or tearing or the adhesive attachment means may thus be prevented, thereby lengthening the useful life of the device.

The handle portion may be in the form of a baseball bat or other design that is aesthetically desirable, the handle portion preferably having a means by which to grip the handle portion for raising or lowering the toilet seat. The handle portion is removably mounted to the attachment portion such that it may be removed for cleaning or for replacement with a handle portion of an alternative design.

Alternatively, the attachment medium may only include an adhesive strip mounted near the outside edge of the attachment portion instead of the larger adhesive pad. The attachment means is thus positioned where pressure between the attachment medium and toilet seat is most direct, thus eliminating the need for a larger attachment means and reducing the potential for detachment of the attachment means.

It is therefore a general object of this invention to provide a handle attachment assembly for raising or lowering a toilet seat without touching any part of the toilet proper.

Another object of this invention is to provide a handle attachment, as aforesaid, which is adhesively attachable to the underside of a conventional toilet seat.

Still another object of this invention is to provide a handle attachment, as aforesaid, which can be raised or lowered without placing unnecessary strain on the adhesive attachment means.

Yet another object of this invention is to provide a handle attachment, as aforesaid, having a handle portion which may be grasped by the fingers or hand of a user, whereby to raise or lower the toilet seat.

A further object of this invention is to provide a handle attachment, as aforesaid, having a lifting member which may be removed for cleaning or replaced with lifting members of various aesthetic designs.

Other objects and advantages of this invention will become apparent from the following description taken in connection with the accompanying drawings, wherein is set forth by way of illustration and example, embodiments of this invention.

DESCRIPTION OF THE PREFERRED EMBODIMENT

Figure 1:
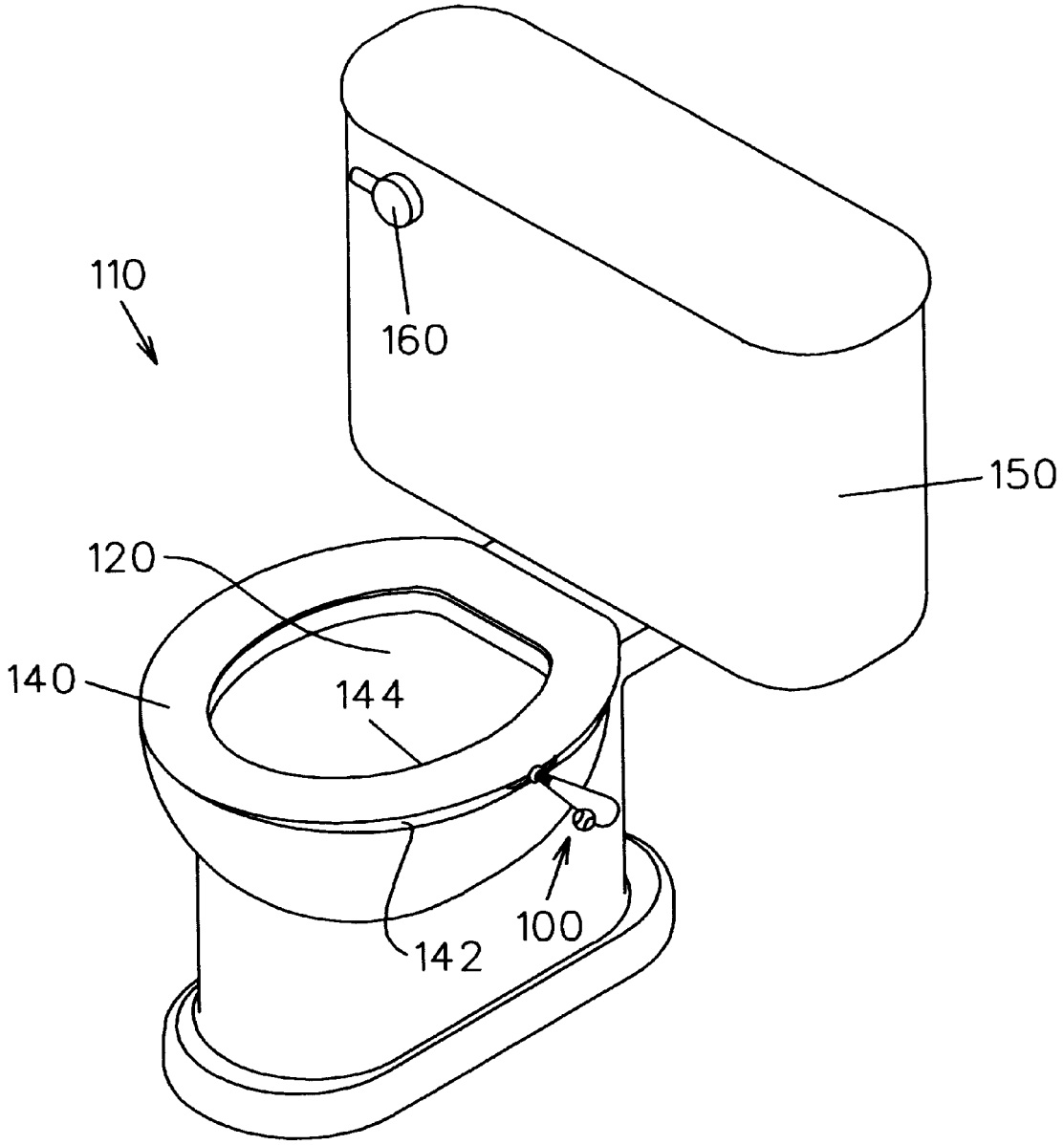
FIG. 1 is a perspective view of a handle attachment assembly in use with a conventional toilet with the seat in a lowered position.
Figure 2:
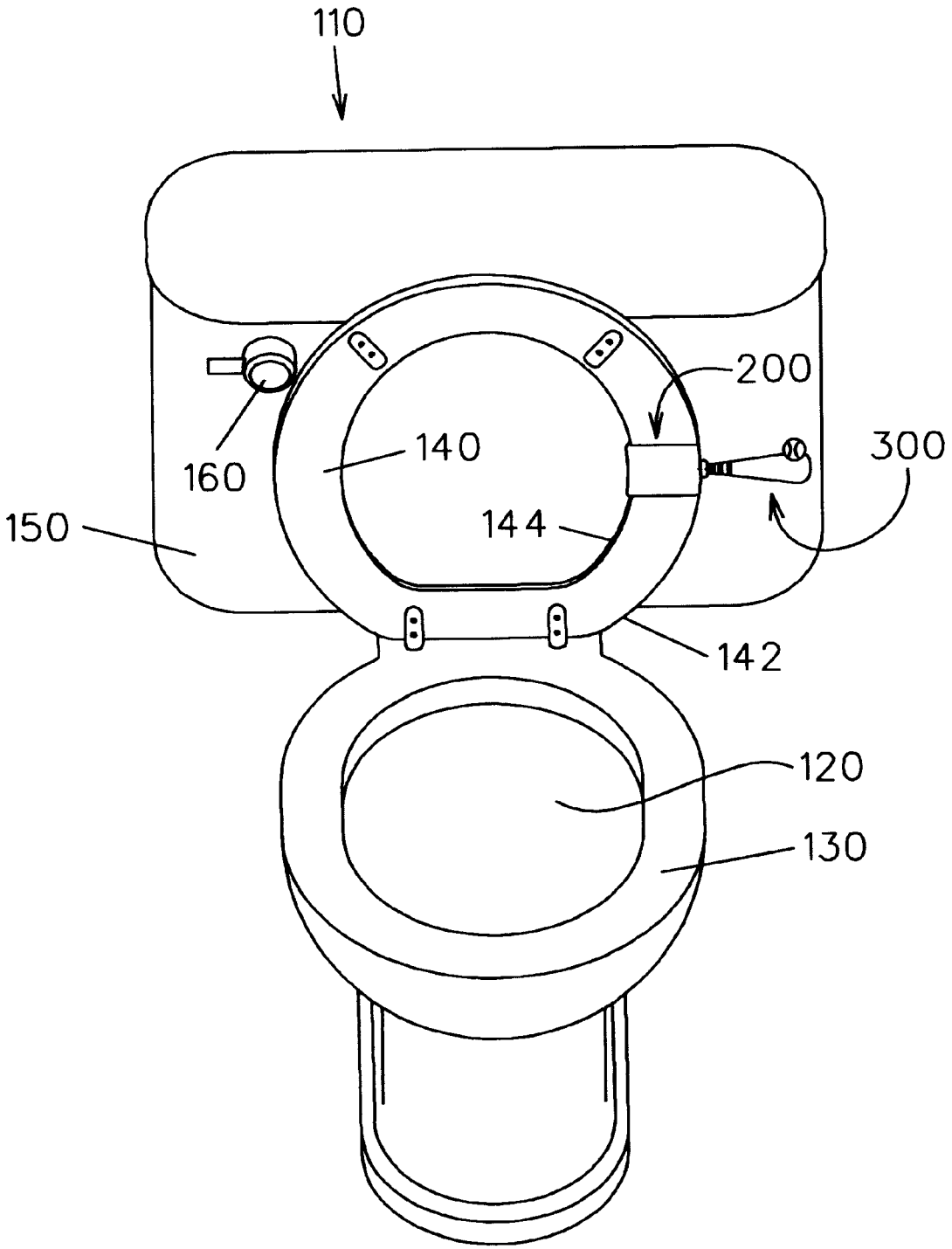
FIG. 2 is a front perspective view of the handle attachment assembly and toilet of FIG. 1 with the seat in a raised position.

Turning more particularly to the drawings, FIGS. 1 and 2 show a conventional toilet 110 having a bowl 120 with an upper rim surface 130 on which a seat 140 is pivotally mounted. The toilet 110 further includes a tank 150 having a handle 160 for a flushing mechanism mounted thereto.

Figure 3:
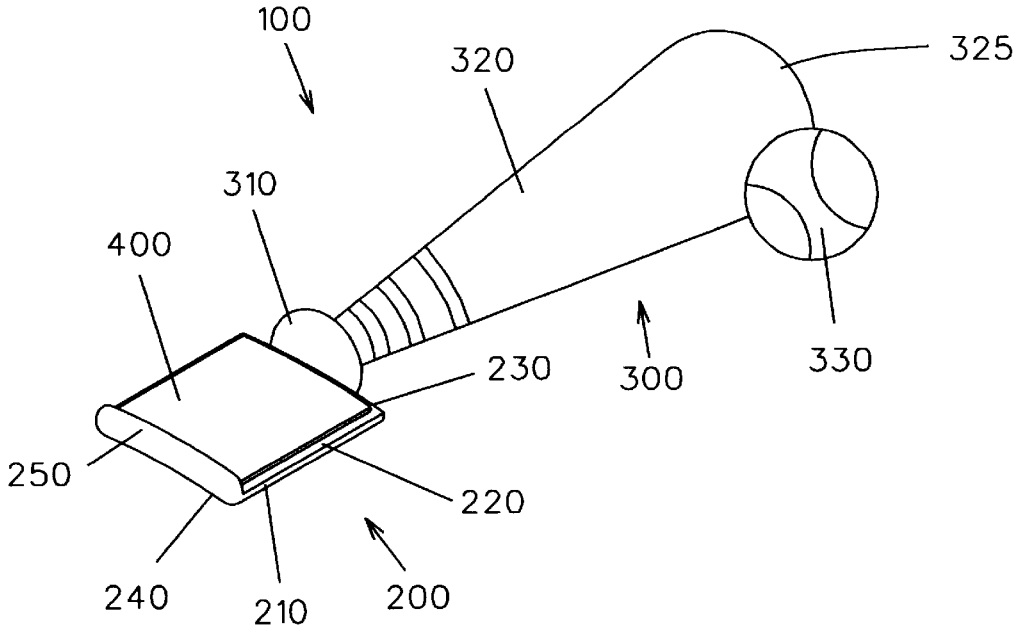
FIG. 3 is a perspective view of one embodiment of the handle attachment assembly.
Figure 5:
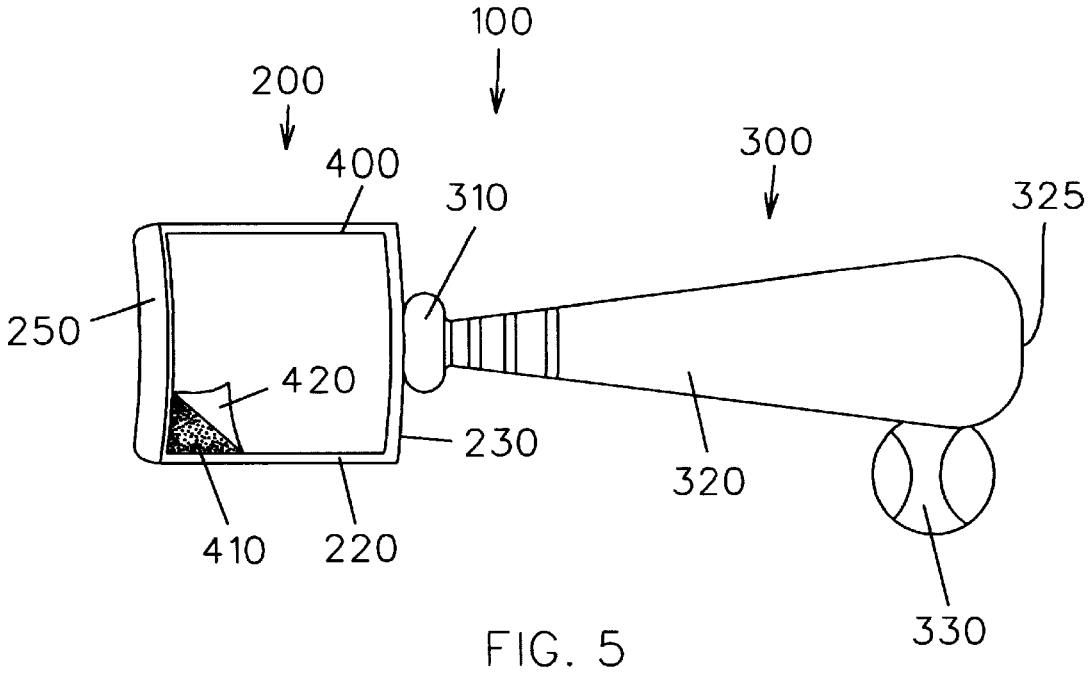
FIG. 5 is top view of the handle attachment assembly of FIG. 3 with a corner of the adhesive cover detached.
Figure 6:
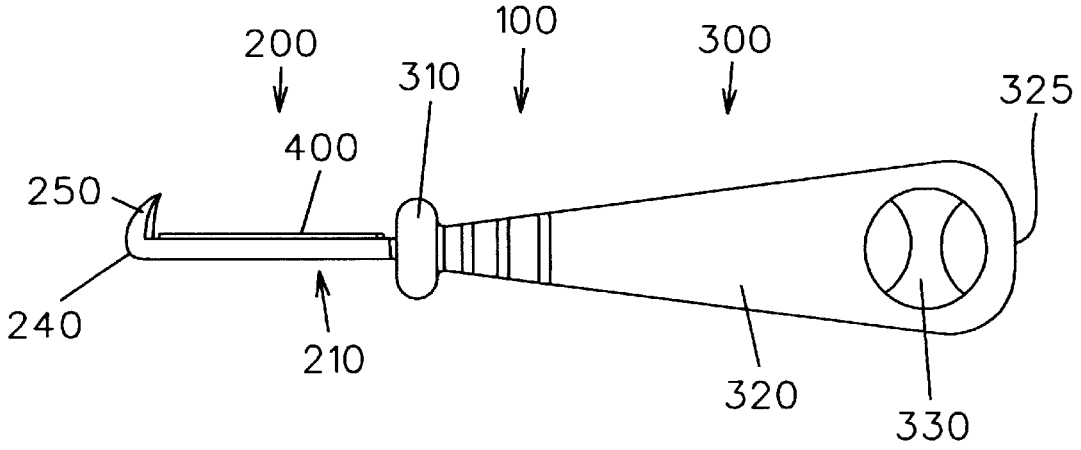
FIG. 6 is a right side view of the handle attachment assembly of FIG. 3.

In one form of the invention, the handle attachment 100 assembly (FIG. 3) includes an attachment plate 200, a handle 300, and a seat attachment means 400 in the form of adhesive 410 with releasable cover 420 thereon. As shown in FIGS. 3, 5, and 6, the attachment plate 200 includes a base 210 having an edge 230 which conforms to the curvature of the outer edge 142 of the toilet seat 140. The attachment plate 200 further includes an opposed edge 240 having an upstanding seat grasping flange 250 integrally attached thereto, the seat grasping flange 250 being parallel to the edge 230 according to the curvature of the seat 140. The seat grasping flange 250 presents a concave surface relative to the planar surface 210 such that the grasping member 250 securely grips the inside edge of the opening of the seat 140 when the seat 140 is maneuvered using the handle 300.

The attachment means 400 is preferably an adhesive pad 410 fixedly and securely mounted to a top side 220 of the planar surface 210 of the attachment plate 200, the adhesive pad 410 substantially covering the top side 220 thereof. The adhesive pad 410 may be in the form of adhesive tape or foam, the adhesive pad 410 being initially protected by a cover 420 such as wax paper prior to installation (FIG. 5). The handle attachment assembly 100 is preferably positioned approximately midway between the front and rear of the toilet seat 140. Installation may be accomplished by peeling the protective cover 420 from the adhesive pad 410 and firmly pressing the pad 410 into contact with the desired location on the underside of the seat 140, making sure the seat grasping flange 250 engages the inner edge 144 of the opening of seat 140 (FIG. 2). Thus, flange 250 serves as a guide for proper alignment of the plate 200 underneath seat 140. Also, the flange 250 relationship preclude dirt from entering this flange 250/edge 144 interface. Moreover, any lateral forces exerted on the handle are resisted by this interface which precludes the adhesive 410 from separating from the seat 140.

The handle 300 is in the form of a baseball bat and thus includes a knob 310 at one end, the knob 310 being integrally joined to an outwardly projecting elongated barrel 320. A baseball 330, or replica of reduced size thereof, may be fixedly attached to the barrel 320 substantially near an outer end 325 thereof, the baseball 330 providing a means for gripping the handle 300 while raising or lowering the toilet seat 140.

Figure 4:
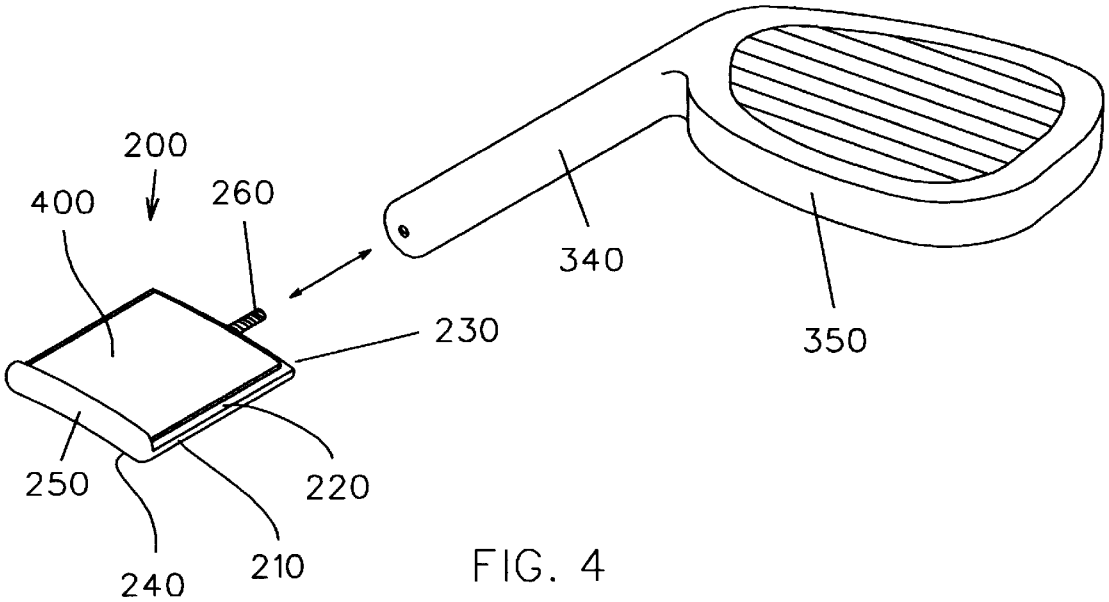
FIG. 4 is a perspective view of an alternative embodiment of the handle attachment of FIG. 3 with the handle removed from the attachment plate.

The handle 300 is demountably coupled to the rear edge 230 of the attachment plate 200 through screwable engagement with a threaded bolt 260 fixedly attached thereto (FIG. 4). Knob 310 bears against the outer edge of the seat 140. The handle 300 is thus removable for cleaning or for attachment of a different handle portion having an alternative design such as a replica of a golf club shaft 340 and head 350 (FIG. 4) or other aesthetic configuration.

Figure 7:
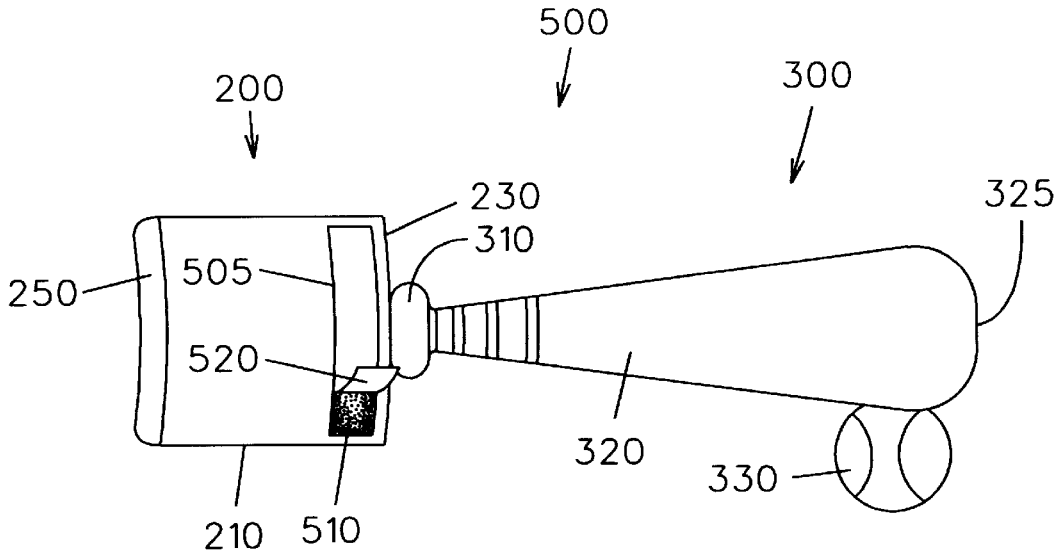
FIG. 7 is a top view of an alternative embodiment of the adhesive medium of handle attachment assembly.
Figure 8:
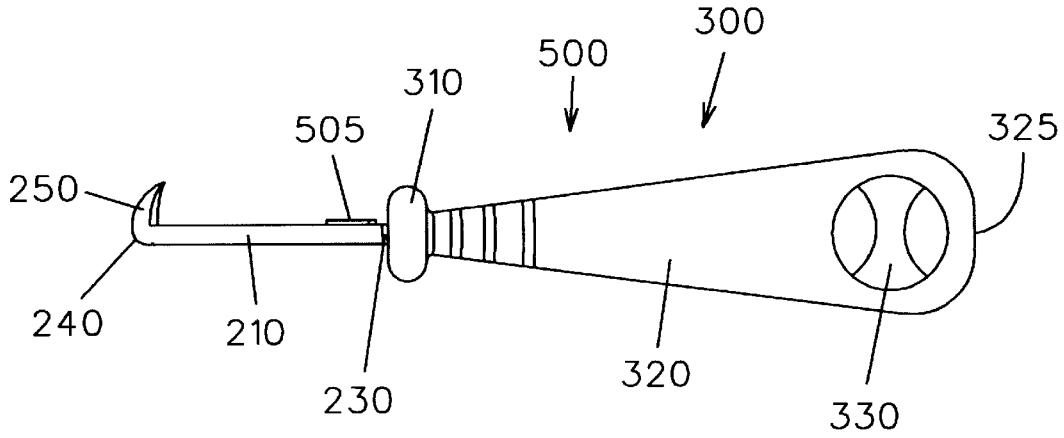
FIG. 8 is a right side view of an alternative embodiment of the handle attachment of FIG. 7.

An alternative embodiment 500 shown in FIGS. 7 and 8 is very similar to the embodiment first described except as discussed below. The attachment means 400 having an adhesive pad 410 has been replaced by an attachment means 505 having a reinforced adhesive strip 510 fixedly mounted to the top side 220 immediately adjacent edge 230 where pressure between the seat 140 and attachment medium 505 is most direct during seat lifting. This position reduces the potential for detachment of the adhesive attachment means at points of reduced pressure between the attachment means and toilet seat. The attachment medium 505 may be adhesive tape or foam and is initially protected by a cover 520.

Accordingly, it can be seen that the handle attachment can raise or lower a toilet seat without a user having to touch any part of the toilet itself. Further, the handle attachment is mounted to the toilet seat both adhesively and with a seat grasping member 250 such that the adhesive attachment means is not unduly strained during use.

It is understood that while certain forms of this invention have been illustrated and described, it is not limited thereto except insofar as such limitations are included in the following claims and allowable functional equivalents thereof.

Having thus described the invention, what is claimed as new and desired to be secured by Letters Patent is as follows:

1. A handle for a toilet seat having an opening, the toilet seat positioned atop a toilet bowl rim, said handle assembly comprising:

a mounting plate having a first lower surface adapted to bear atop a toilet bowl rim and an upper surface adapted to bear against an underside of a toilet seat;

first and second laterally spaced-apart edges on said plate;

a single upstanding flange extending from said first edge of the plate and presenting a vertical surface, said vertical surface adapted for contiguous placement against an inside edge of the opening of the toilet seat, said contiguous placement positioning said second edge of said mounting plate at a position adjacent an outside edge of the seat;

adhesive means on said upper surface of said plate adjacent said second edge of said mounting plate for affixing said plate to the underside of the toilet seat; and a handle for user grasping connected to said second edge of said plate, a user manipulation of said handle producing forces on said handle and said mounting plate, said forces resisted by said adhesive means and said flange contiguous placement.

2. A handle for a toilet seat having an opening, the toilet seat positioned atop a toilet bowl rim, said handle assembly comprising:

a mounting plate having a first lower surface adapted to bear atop a toilet bowl rim and an upper surface adapted to bear against an underside of a toilet seat;

first and second laterally spaced-apart edges on said plate;

a single upstanding flange extending from said first edge of the plate and presenting a convex vertical surface, said convex vertical surface adapted for contiguous placement against a concave edge of the opening of the toilet seat for resisting forces acting on said flange, said contiguous placement positioning said second edge of said mounting plate at a position generally adjacent an outside edge of the seat;

adhesive means along said second edge of said upper surface of said plate for affixing said plate to the underside of the toilet seat;

means extending from said second edge of said plate for releasable attachment of a handle thereto; and a handle for user grasping connected to said releasable attachment means, the forces acting on said flange resulting from a user manipulation of said handle, said flange cooperating with said adhesive means to resist the user forces on said handle.

3. A handle assembly for a toilet seat having an opening, the toilet seat pivotally mounted to a toilet bowl rim, said handle assembly comprising:

a mounting plate having a first lower surface adapted to bear against a toilet bowl rim and an upper surface adapted to be positioned contiguous an underside of a toilet seat, said mounting plate having a width corresponding to a width of the toilet seat;

first and second laterally spaced-apart edges on said plate, said respective edges adapted to lie adjacent an edge of the opening and adjacent an outside edge of the toilet seat, said plate edges having a curvature adapted to follow a curvature of the edge of an opening of the toilet seat and the outside edge of the toilet seat;

a single upstanding flange extending from and completely along said first edge of the plate and presenting a vertical surface, said vertical surface having a curvature corresponding to the curvature of the edge of the opening of the toilet seat whereby to be adapted for contiguous placement against the edge of the opening of the toilet seat to resist forces acting on said plate, said flange contiguous placement cooperating with said mounting plate width for positioning said second edge of said mounting plate at a position generally collinear with the outside edge of the seat;

adhesive means on said upper surface of said plate and at least adjacent said second edge of said plate for affixing said plate to the underside of the toilet seat with said flange in said contiguous placement;

means extending from said second edge of said plate for releasable attachment of a handle thereto; and a handle adapted for user grasping connected to said releasable attachment means.

4. The assembly as claimed in claim 3 wherein said affixing means comprises an adhesive strip.

5. The assembly as claimed in claim 4 wherein said adhesive generally covers an entirety of said plate upper surface.

6. The assembly as claimed in claim 4 wherein said adhesive is confined to a position along said upper surface adjacent said second plate edge.

7. The assembly as claimed in claim 4 further comprising a releasable cover atop said adhesive.

8. The assembly as claimed in claim 3 wherein said attachment means comprises:

a bolt extending from said second edge having a plurality of threads therearound;

an aperture in said handle;

a plurality of threads about an interior of said apertures, said aperture threads engageable with said bolt threads to screw said handle on said bolt.

9. The assembly as claimed in claim 3 wherein said handle is in a form of a baseball bat.

10. The assembly as claimed in claim 3 wherein said handle is in a form of a golf club head.

* * * * *

UNITED STATES PATENT AND TRADEMARK OFFICE

CERTIFICATE OF CORRECTION

PATENT NO. : 5,963,992

DATED : October 12, 1999

INVENTOR(S) : Sam W. Bonner

It is certified that error appears in the above-identified patent and that said Letters Patent is hereby corrected as shown below:

Column 4, line 12, after "handle" insert --assembly--.

Column 4, line 34, after "handle" insert --assembly--.

Signed and Sealed this

Fourth Day of July, 2000

*Attest:*

Q. TODD DICKINSON

*Attesting Officer*

*Director of Patents and Trademarks*